US005141483A

United States Patent [19]

Smith

[11] Patent Number: 5,141,483

[45] Date of Patent: Aug. 25, 1992

[54] EXERCISE APPARATUS FOR LUMBAR AND TRUNCAL REGIONS

[76] Inventor: David C. Smith, 1385 Preston Way, Venice, Calif. 90291

[21] Appl. No.: 821,832

[22] Filed: Dec. 23, 1991

Related U.S. Application Data

[63] Continuation-in-part of Ser. No. 640,986, Jan. 14, 1991, abandoned.

[51] Int. Cl.[5] ..... A63B 26/00

[52] U.S. Cl. ..... 482/142; 606/243; 606/244

[58] Field of Search ..... 482/142, 146, 148; 269/325; 606/242, 243, 244

[56] References Cited

U.S. PATENT DOCUMENTS

| | | | |
|---|---|---|---|
| 1,011,038 | 12/1911 | Davenport | 128/74 |
| 1,076,475 | 10/1913 | Albright | 128/74 |
| 1,400,546 | 12/1921 | Holme | 128/74 |
| 3,620,210 | 11/1971 | Annas et al. | 128/74 |
| 3,911,907 | 10/1975 | Smith, Jr. | 128/25 R |
| 4,285,516 | 8/1981 | Heatwole | 272/146 |
| 4,582,311 | 4/1986 | Steffensmeier | 269/325 |
| 4,846,465 | 7/1989 | Iams et al. . | |
| 4,858,918 | 8/1989 | Iams et al. . | |
| 4,953,857 | 9/1990 | Lemire | 482/142 |
| 5,007,633 | 4/1991 | Lemire | 482/142 |

*Primary Examiner*—Richard J. Apley
*Assistant Examiner*—Lynne Reichard
*Attorney, Agent, or Firm*—Andrew Jordan

[57] ABSTRACT

An apparatus for exercising the lumbar and truncal regions of a person. A rigid framework supports two generally horizontal turntables at opposite ends thereof. A person reclines the upper region of his torso on one turntable and lower region of his torso on the other turntable, thereby permitting cyclic bending of the torso and, as a result, working of the paraspinous and associated muscles. An adjustable headrest extends from one turntable, and an adjustable footrest extends from the other turntable. Each turntable may be adjusted toward or away from the other, set at a predetermined tilt with respect to the rigid frame, and set at a predetermined degree of rotational resistance. A cyclic motion driving means and a cycle counter are provided.

9 Claims, 4 Drawing Sheets

EXERCISE APPARATUS FOR LUMBAR AND TRUNCAL REGIONS

This application is a continuation-in-part of application Ser. No. 640,986, filed Jan. 14, 1991, now abandoned.

FIELD OF THE INVENTION

This invention relates to exercise apparati. More particularly, this invention relates to exercise apparati for the lumbar and truncal regions of a person's body.

BACKGROUND OF THE INVENTION

It has long been known that if a muscle is introduced to a strain to which it is not accustomed it may be damaged, thereby causing pain and discomfort. The muscles of a human body associated with the lumbar and truncal regions, or the paraspinous muscles, are particularly vulnerable to such damage in part because of a natural difficulty in exercising these muscles of the body in an effective manner. It seems most natural to exercise these muscles through bending or stretching exercises while in a standing or sitting position. Yet when a person's back is in a generally vertical orientation, gravity introduces an axial loading on his spinal joints that inhibits the full motion of the paraspinous muscles, thereby limiting the effectiveness of exercising these muscles while in a vertical orientation. Proper exercising of the paraspinous muscles can be accomplished most readily only when a person is in a horizontal orientation. However, it is also difficult to exercise the paraspinous muscles when in a horizontally prone or supine position on a flat surface due to friction of a person's body on the horizontal surface.

Given the natural difficulty in exercising the lower spinal muscles, several devices have been designed to facilitate more effective exercising thereof. These devices usually require a person to stand or sit in an essentially vertical position during use, thereby forcing the user to overcome axial loading by gravity in order to fully extend and exercise his paraspinous muscles. Consequently, the effectiveness of these devices is reduced.

Other currently available devices cause the user to assume an "all fours" position, similar to when in a crawl, to ensure a horizontal orientation of the back and spine. Yet these devices require the user to support himself in an "all fours" position while the device is used. Consequently, these devices lessen the amount of time the user can exercise his paraspinous muscles due to fatigue in other muscles, such as those of the arms and legs that are used to support the person in an "all fours" position. Further, persons who have experienced spinal injury or deformation may not be able to support themselves on their arms and legs, making the use of such a device extremely difficult.

Clearly there exists a need for a device that will permit the user to fully and effectively exercise his paraspinous muscles, but not require the user to overcome either axial loading by gravity, or fatigue due to a difficult-to-maintain exercise posture.

SUMMARY OF THE INVENTION

The present invention is an exercise apparatus comprising a rigid framework that supports two turntables mounted at either end of the framework, each turntable being supported by the framework in a generally horizontal orientation and free to rotate around its vertical axis. Both turntables are adjustably mounted along the framework so as to permit persons of varying sizes to utilize the apparatus. Further, each turntable is tiltable with respect to the framework so as to permit the exercising of a variety of muscles and adapt to persons with spinal deformations or injuries.

In use, a person reclines his upper torso upon one turntable, sized and shaped appropriately to receive and comfortably support a person's upper torso, and then positions his lower torso on the other turntable, also sized and shaped appropriately, so that he is in a generally horizontal and supine position. The person then bends his torso repeatedly left and right, causing the turntables to pivot about their vertical axes in opposite directions. A fully adjustable headrest extends from the turntable that supports the user's upper torso. Likewise, a fully adjustable footrest extends from the turntable that supports the user's lower torso.

The invention permits the paraspinous muscles of the person to be worked while providing a generally horizontal orientation of the spine and back. Further, muscles not associated with the lower spine and back remain relaxed while the invention is used, and consequently the fatigue of these muscles is not a factor in the duration of use of the invention.

Other features and advantages of the present invention will become apparent from the following more detailed description, taken in conjunction with the accompanying drawings, which illustrate, by way of example, the principles of the invention.

DESCRIPTION OF THE DRAWINGS

The accompanying drawings illustrate the invention. In such drawings.

DETAILED DESCRIPTION OF THE INVENTION

Figure 1:
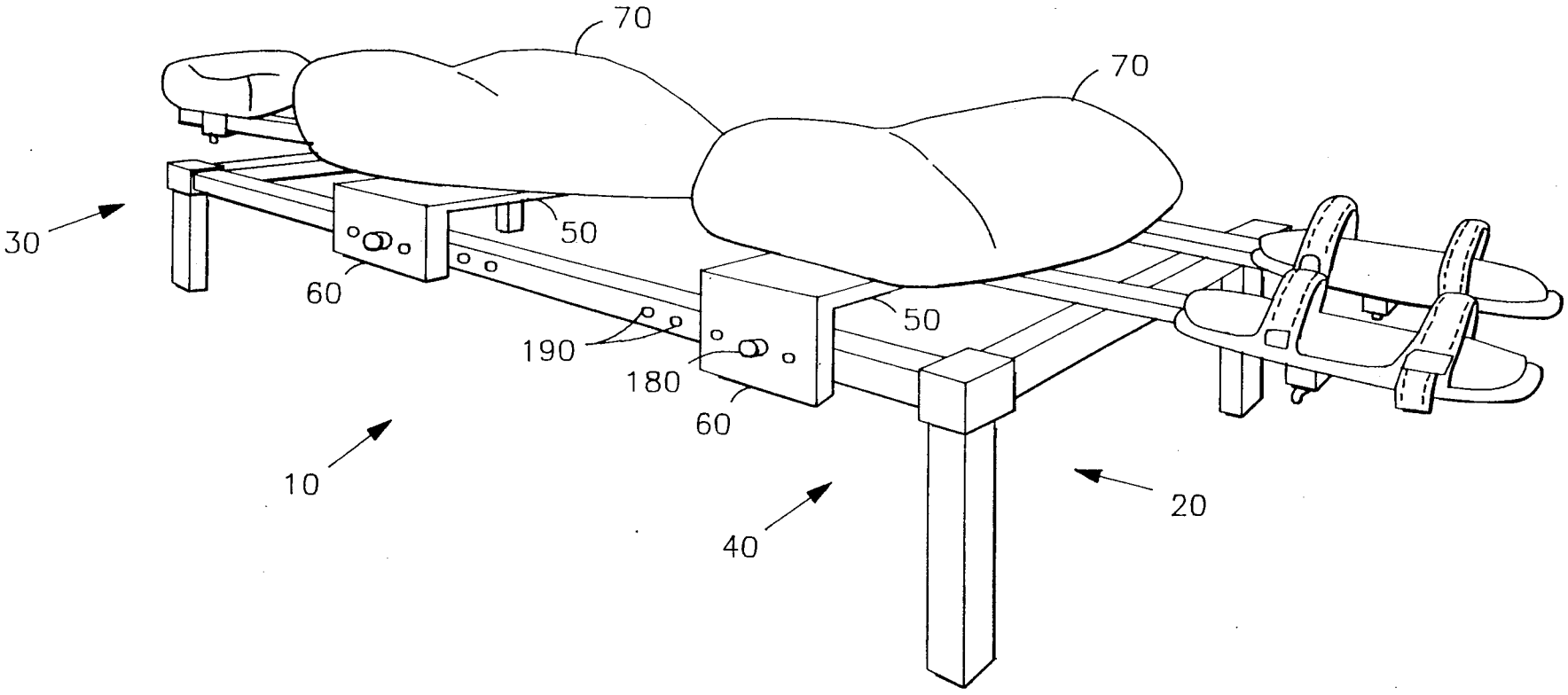
FIG. 1 is a perspective illustration of one embodiment of the invention.
Figure 2:
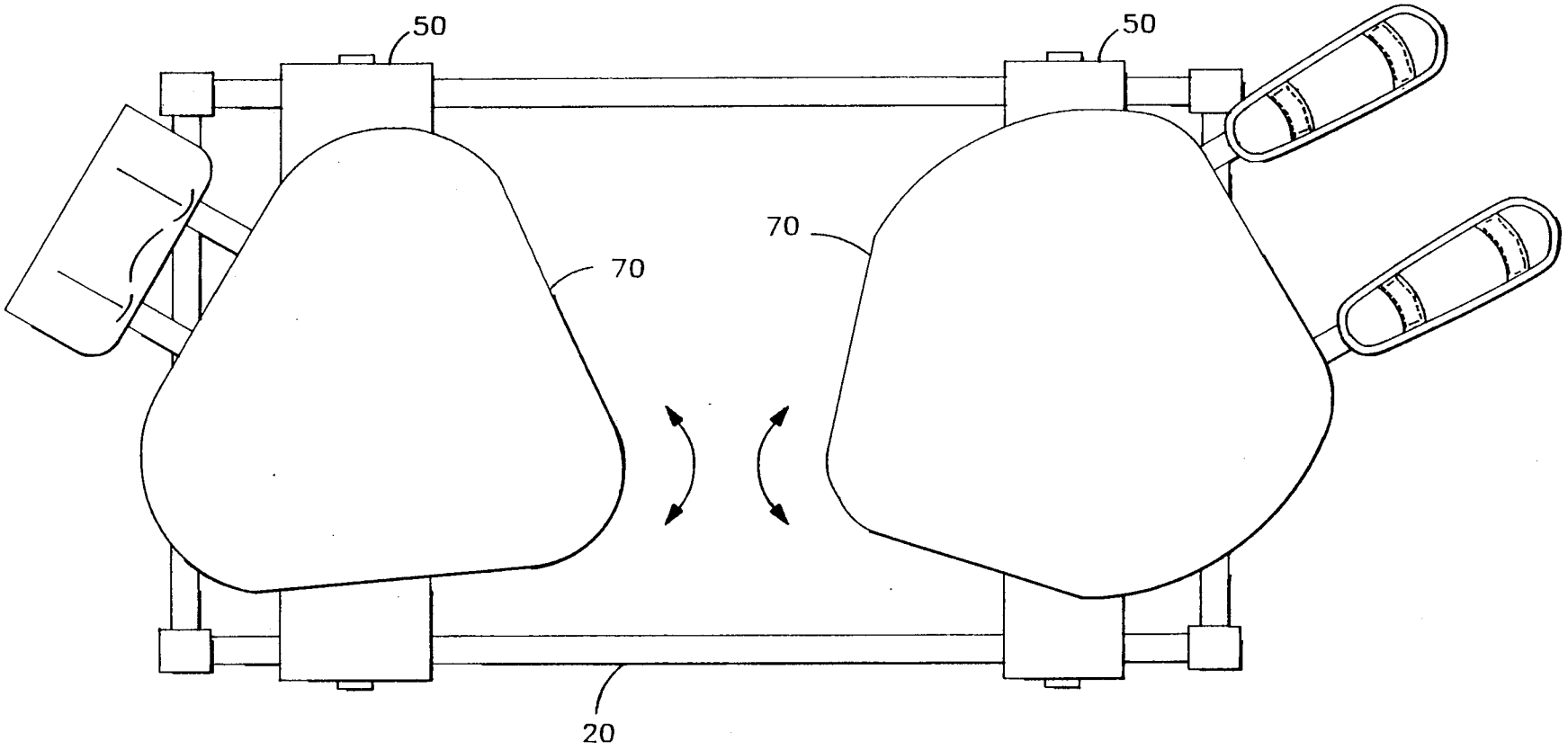
FIG. 2 is a top plan view of the invention showing each horizontal turntable rotated slightly in opposite directions.
Figure 3:
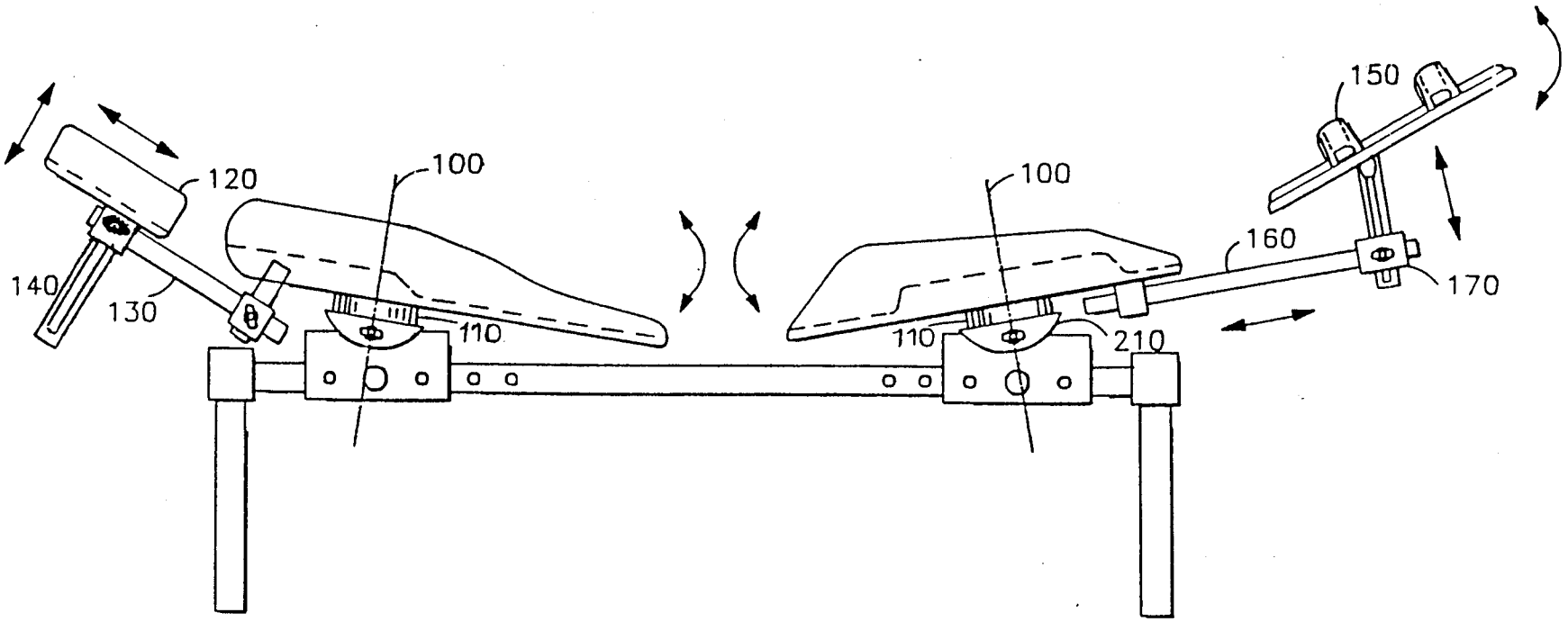
FIG. 3 is a right side elevation view of the invention showing each turntable slightly inclined from a horizontal position.
Figure 4:
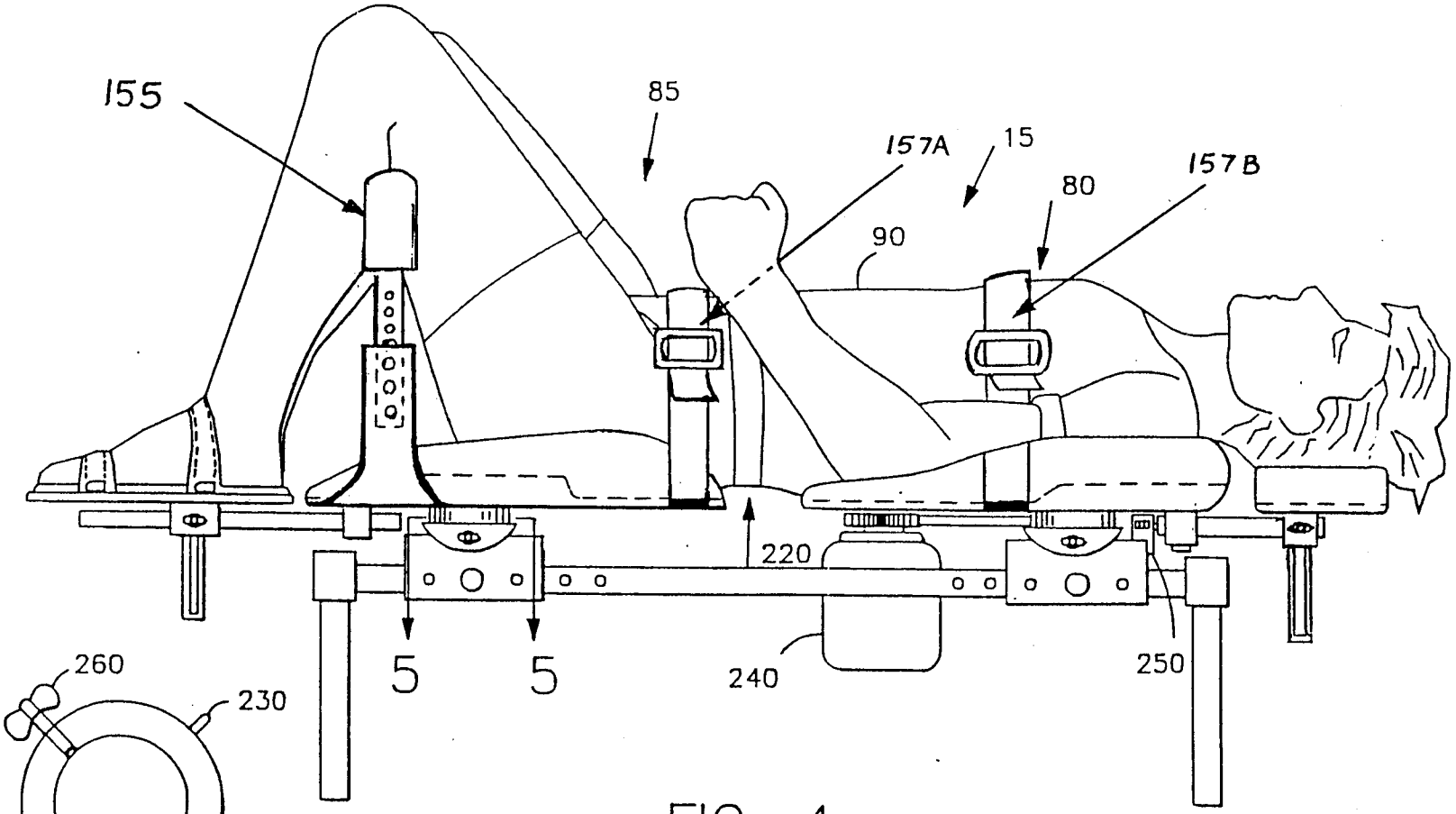
FIG. 4 is a left side elevation view of the invention illustrating a person engaged therein.
Figure 5:
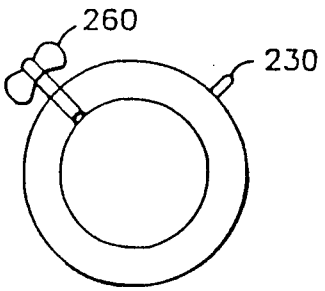
FIG. 5 is a top plan cross-sectional view of the rotational mounting means of the invention taken generally along lines 5—5 of FIG. 4.

FIGS. 1-4 illustrate an exercise apparatus 10 for a person 15 comprising a rigid frame 20 having a proximal end 30 and a distal end 40. A pair of turntable support means 50 are placed atop the rigid frame 20 at horizontally adjacent positions. Each turntable support means 50 has a slidable attachment means 60 to enable adjustment of the space between the pair of turntable support means 50, and to enable attachment to the rigid frame 20. A pair of horizontal turntables 70 for supporting an upper portion 80 and a lower portion 85 of a torso 90 of the person 15 are provided that each have a vertical rotational axis 100 and a rotational mounting means 110. Each rotational mounting means 110 is formed atop one turntable support means 50. Preferably, the rigid frame 20 and turntable support means 50 are formed of a suitably strong metal or plastic, providing enough strength for the exercise apparatus 10 to support any weight of person 15. Each turntable 70 is also formed from of a strong metal or plastic, yet may also contains a soft, pliable material on its upper surface for comfortable contact with the person 15. Each turntable 70 may have a padded saddle shape. When each turntable respectively supports the upper back and buttock areas, the torso will tend to maintain a central position. Preferably, each turntable 70 also includes a restraining means, 157*a*, 157*b* that will enable the person 15 to be placed in traction when the turntables 70 are moved away from each other.

A headrest 120 is attached to one turntable 70 at the proximal end 30 of the rigid frame 20 by at least one headrest support arm 130. The headrest 120 has a headrest position adjustment means 140 to accommodate a range of sizes of the person 15. Similarly, a footrest 150 is attached on the turntable 70 at the distal end 40 of the rigid frame 20 by at least one footrest support arm 160. The footrest 150 has a footrest position adjustment means 170 to accommodate a range of sizes of the person 15. Both the headrest position adjustment means 140 and footrest position adjustment means 170 may also be used to accommodate a person having a spinal deformity caused through disease or injury.

A leg support 155 may be provided to support and stabilize the legs of a user while the exercise apparatus is in operation. Preferably, the leg support 155 is adjustable. Along similar lines, restraining straps 157*a*, 157*b* may be used to stabilize the torso of a user while the exercise apparatus is in operation.

A locking means 180 is included in the slidable attachment means 60 such that any one of a plurality of selected axial positions 190 of the turntables 70 on the rigid frame 20 may be chosen. Moreover, a tilting means 210 of the turntables 70 is provided on each rotational mounting means 110 such that any one of a plurality of selected tilt positions 210 may be chosen to accommodate the flexing and counter flexing of paraspinous muscles 220 of the person 15. An adjustable rotation limiting means 230 is provided on each rotational mounting means 110 to provide a limited range of motion of the turntables 70. Also provided on at least one rotational mounting means 110 is a cyclic motion driving means 240, such as a standard motor, used for automatic oscillation of at least one turntable 70. A rotational resistance means 260 is provided on each rotational mounting means 110, and may be as simple as a thumbknob screw frictionally engaging each rotational mounting means 110. The rotational resistance means 260 may also be incorporated in the cyclic motion driving means 240. A cycle counter 250 is provided that increments by one for each oscillation of the turntables 70, and is capable of manually being reset to zero.

In use, the person 15 reclines upon the horizontal turntables 70 with the upper portion 80 and the lower portion 85 of the torso 90 of the person 15 being respectively supported on one of the turntables 70. The person 15 may easily exercise the torso 90 by forcing each turntable 70 to rotate in oscillatory motion about each rotational mounting means 110, thereby working the paraspinous muscles associated with lateral bending of the torso 90. Alternatively, a person supported by the horizontal turntables 70 may activate the cyclic motion driving means 240, thereby automatically flexing the paraspinous muscles, as is sometimes necessary for healing in the case of spinal injury.

While the invention has been described with reference to a preferred embodiment, it is to be clearly understood by those skilled in the art that the invention is not limited thereto. For example, while the turntables 70, headrest 140, and footrest 150 are all, in the preferred embodiment, adapted for use with the person 15 in a supine position, other turntables 70, headrests 140, and footrests 150 can be provided to accommodate a person laying in prone or sideways positions. Further, the cyclic motion driving means 240 can be adapted to alter its speed or shut off when the cycle counter 250 reaches a predetermined number. Alternatively, the cyclic motion driving means 240 may be activated only to provide a predetermined degree of rotational resistance. Thus, the scope of the invention is to be interpreted only in conjunction with the appended claims.

What is claimed is:

1. An exercise apparatus for a person, comprising:

a rigid frame having a proximal end and a distal end;

a pair of means for turntable support placed atop said rigid frame at horizontally adjacent positions, each means for turntable support having means for slidable attachment to said rigid frame enabling adjustment of the space between said pair of means for turntable support; and a pair of horizontal turntables for supporting upper and lower portions of said person's torso, each turntable having a vertical rotational axis and a means for rotational mounting atop one said means for turntable support, each said turntable having a padded saddle shape such that the upper back and the buttock areas are supported wherein the torso tends to maintain a central position on said turntables, whereby said person may recline upon said horizontal turntables with said upper and lower portions of said torso of said person being respectively supported on one of each said turntables so that said person may easily exercise said torso by forcing each said turntable to rotate in oscillatory motion about each said means for rotational mounting thereby working the muscles associated with lateral bending of said torso.

2. The exercise apparatus of claim 1 further including a headrest attached to one said turntable at said proximal end of said frame, by at least one headrest support arm and having means for headrest position adjustment to accommodate a range of sizes of said person.

3. The exercise apparatus of claim 1 further including a footrest attached to one said turntable at said distal end of said frame, by at least one footrest support arm and having means for footrest position adjustment to accommodate a range of sizes of said person.

4. The exercise apparatus of claim 1 wherein each said means for slidable attachment to said rigid frame has a means for locking in any one of a plurality of selected positions.

5. The exercise apparatus of claim 1 wherein each said means for rotational mounting has a means for tilting said horizontal turntable into any one of a plurality of selected positions to accommodate the flexing and counter flexing of the back muscles of said person while performing said exercise.

6. The exercise apparatus of claim 1 wherein each said means for rotational mounting has a means for limiting the range of rotation.

7. The exercise apparatus of claim 1 wherein each said means for rotational mounting has a means for driving in cyclic motion.

8. The exercise apparatus of claim 1, further comprising a leg support, said leg support stabilizing the legs of a user upon said exercise apparatus.

9. The exercise apparatus of claim 1, further comprising at least one restraining strap, said restraining strap stabilizing a user upon said exercise apparatus.

* * * * *